US007217342B2

(12) United States Patent
Kangas et al.

(10) Patent No.: US 7,217,342 B2
(45) **Date of Patent: *May 15, 2007**

(54) APPARATUS FOR PAPER MAKING AND PAPER SURFACE ENHANCEMENT

(76) Inventors: Martti Y. O. Kangas, 3067 McCully Dr. NE, Atlanta, GA (US) 30345; Marjatta F. Kangas, 3067 McCully Dr. NE, Atlanta, GA (US) 30345

( * ) Notice: Subject to any disclaimer, the term of this patent is extended or adjusted under 35 U.S.C. 154(b) by 0 days.

This patent is subject to a terminal disclaimer.

(21) Appl. No.: 10/721,406

(22) Filed: Nov. 24, 2003

(65) Prior Publication Data

US 2005/0098291 A1 May 12, 2005

Related U.S. Application Data

(60) Provisional application No. 60/499,406, filed on Sep. 2, 2003, provisional application No. 60/429,362, filed on Nov. 26, 2002, provisional application No. 60/428,781, filed on Nov. 25, 2002.

(51) Int. Cl.
*D21F 1/00* (2006.01)

(52) U.S. Cl. ..... 162/292; 162/308; 162/300; 162/275; 162/213; 239/399; 239/400; 239/422

(58) Field of Classification Search ..... 162/292, 162/308, 300, 275, 202, 203, 204, 205, 213; 239/399, 400, 422
See application file for complete search history.

(56) References Cited

FOREIGN PATENT DOCUMENTS

| | | | |
|---|---|---|---|
| DE | 2445602 | * | 3/1975 |
| GB | 835 670 | * | 5/1960 |

* cited by examiner

*Primary Examiner*—Mark Halpern
(74) *Attorney, Agent, or Firm*—Rodgers & Rodgers

(57) ABSTRACT

A process that can utilize current paper manufacturing facilities by adding consecutive spray apparatuses that can make and/or enhance the manufacture of a multitude of specific paper products on-line, or improve the properties of already formed paper products with consequent spraying steps on-line or off-line.

11 Claims, 15 Drawing Sheets

VERTICAL INSTALLATION - ALT 1

SPRAY BOX UNIT

VERTICAL INSTALLATION - ALT 1

VERTICAL INSTALLATION - ALT 2

STEAM, OR COLD/HOT GAS BLADE

NON-METERING DOCTOR BLADE EXAMPLES

HYDROPLANING ROLL - ALT 1

HYDROPLANING ROLL - ALT. 2

NOZZLE CONTROL SYSTEM

SPRAY HEADER

MOTIVE GAS HEADER

EXCESS GAS WASHER

PAPER WEB FORMING BY SPRAYING

SPRAYING OF PLY-BOND FOLLOWED BY WEB SURFACING

SPRAYING OF WEB TREATMENT ON DRYER SECTION

SPRAYING OF WEB TREATMENT IN MACHINE BASEMENT

APPARATUS FOR PAPER MAKING AND PAPER SURFACE ENHANCEMENT

The benefits under 35 U.S.C. 119 are claimed of provisional patent applications 60/428,781 filed Nov. 25, 2002; 60/429,362 filed Nov. 26, 2002 and 60/499,406 filed Sep. 2, 2003.

FIELD OF THE INVENTION

This invention relates to paper manufacturing process itself and to paper and board surface enhancement in the paper and board manufacturing processes.

BACKGROUND OF THE INVENTION

The paper is conventionally formed from a suspension of about 0.4% to 1.2% fiber solids (fibers) through a so called head box by spreading the suspension on a moving rotating wire, or a nip, formed by two rotating wires, followed by removing the suspension water as much as possible in consequent process steps through vacuum, pressing and drying.

During paper web forming process or immediately thereafter, web interior and surfaces will require treatments to bring paper properties to acceptable level. These properties include printability, rigidity, strength and chemical penetration that are achieved through chemical treatment, filling and coating materials, and mechanical doctoring processes, some of which are specific for different paper and board grades.

To increase paper whiteness and paper printing properties, the first approach is to add fillers, such as kaolin, and mix them together with around 1% fiber solution to reach filler contents typically from 5% to 35% in the final paper or board. However, up to 40% of these fillers go through the forming paper web on a moving wire, ending into recirculation.

The so called ply-bond between two paper layers is currently achieved by excessive refining of the fibers or by spraying a dilute 2% starch on wire section between the layers. The low solids content is currently needed to minimize aerosol formation and nozzle plugging.

Paper surface strength and rigidity are accomplished by surface sizing during the paper drying process. The size is typically added by immersing the sheet into the size solution at around 8% solids, or by applying size films with a two roller nip on dry paper sheet surfaces at 8% to 10% consistency. The low consistency causes considerable amount of paper rewetting requiring re-drying. The sheet must be fully dry at the application points as it can not otherwise withstand the mechanical forces around these processes.

Paper is coated by adding up to 90% excess coating solution on the paper side and doctoring the excess solution to recirculation system. The coating solutions have typically high viscosity with solids from about 45% to 65%. The paper must be fully dry before first coating is applied and must also be dried between the consequent coating solution applications. Wet paper can not withstand the mechanical forces that are higher than with sizing. In this process the coating solution, often at zero initial machine speed, hits the paper web moving at speed up to 1800 meters per minute, accelerates to this speed, and comes to a full stop when up to 90% excess is doctored away for the desired coat weight on the paper or board surface.

Most of the paper grades are re-moisturized during the drying process to correct for the continuously changing CD moisture profile resulting from the shifting imbalances in the dryer section and slowly changing mechanical conditions on the machine.

The existing paper making, filling, sizing and coating methods lack the ability to apply a precise amount of material on the sheet to a specific position and can not as such provide means for cross directional (CD) profiling. Among these the paper making process itself has had a best CD profiling capability through a somewhat flexible metal lip opening in the so called Head Box that distributes the flow on a moving wire or wire nip. The lip opening is narrowed or widened through automated mechanical screws or thermally expanding metal bars. Unfortunately the total dynamics of this process at around 1% solids is difficult to master as every move has an impact elsewhere around it. Industry developed several computer algorithms to master the process but this was not enough. The next step was a so called dilution Head Box, where the individual Head Box sections are diluted with r circulating water to achieve the desired material amount to a specific position. This was a major improvement for the industry but it still lacks the ability to fully control the process especially against the still shifting fiber orientation that will at the end impair the product quality.

This invention of paper fiber spraying allows complete control over the fiber orientation at any position, and additionally it allows a precise spray layer based engineering of the paper sheet in such a way that none of the current methods can do and provides the first time the ability to make fully engineered paper utilizing the variety of raw materials maximally.

The use of original spraying technology for paper re-moisturizing turned to a huge success with advancement of computer technology in the early 70's. Spraying of other materials has periodically been tested e.g. for paper surfacing but the results were largely unsuccessful. Even the latest applicator methods as presented in the U.S. Pat. No. 4,944,960 with improvements shown in the European Patent EP 0682571 still lack their first commercial application. The paper manufacturing itself has also been tried with gap sprayer technology but so far without success. One of the key components for fiber spraying is the nozzle shown in the recent U.S. Pat. No. 6,866,207 by Kangas.

For spraying the nozzle must be energy efficient, the spraying direction must essentially be downwards with gravity when other liquids than water are sprayed, the aerosols must be controlled, the spray pattern must be stable at varying nozzle flow rates for CD profiling, and in some cases the spray fog that has attached onto the substrate has to be doctored with a specific doctoring device according to this invention. The systems are illustrated in FIGS. 12, 13, 14 and 15.

The benefits of this invention can be summarized as follows:

- All paper and board filling, sizing, coating, and barrier surfacing can be accomplished in a simple and efficient way using this spraying process.
- All paper and board grades can be manufactured using this spraying process leading to sizeable savings in the energy consumption of their manufacturing.
- Paper and board can now be engineered through spray-layer approach according to this invention.
- The system poses no limitations to the paper machine operating speed and is a major improvement in paper machine operating efficiency and productivity.
- Lower strength and other raw materials can be utilized more efficiently throughout the paper making process.

The aerosol release to work environment is eliminated. Aerosols are formed whenever material is sprayed in room air environment and in film splitting typically found in size presses and similar paper pigmenting process.

OBJECTS OF THE INVENTION

An object of the invention is to provide a process using current paper manufacturing facilities and consecutive spray apparatuses that enhance the manufacture of a multitude of specific paper products on-line, or improve the properties of already formed paper products with consequent spraying steps.

BRIEF SUMMARY OF THE INVENTION

According to this invention, one spray apparatus with one or several consecutive separately supplied rows of nozzles applies a continuous seamless and fully controllable spray mist and particle mat on a moving wire or paper web using a battery of nozzles that use steam and other gases as a propellant that can be hot or cold, and are sometimes made wet with water or chemicals.

One spray unit is generally a closed, but bottomless box, with ventilation option to capture aerosols and excess gases to the purification and material recirculation, as desired. This box is located so that its opening faces, in close proximity, the receiving surface, that is typically a moving paper manufacturing cloth, called wire, or paper web, or a nip where two of these wires are combined together from opposite sides, a combination nip of a wire and a already formed paper web, or a fully formed paper web. A complete paper manufacturing line can have several of these units after each other in various positions, in vertical to horizontal locations, but generally above the web, in the paper machine to fulfill the required material additions in paper manufacturing and surfacing processes that are needed to complete a specific paper or board product that is being made. Each spray box can have its own cross directional and machine directional control systems that can be integrated to a centralized paper machine control system.

The formed spray is directed towards the opening from inside the box and further towards the mowing wire of paper web in close proximity of it. In case that the receiving element is a wire, the fineness of this wire is selected to capture most of the sprayed materials like paper manufacturing fibers. Only a few of the first fibers originating from the first spray unit that are sprayed on the wire have a change passing through the wire to the recirculation system while the rest will accumulate on a already formed fiber mat. In later spray units all materials and chemicals are accumulating on the moving paper web. The accumulation can sometimes be assisted with a vacuum applied on the opposite side of the wire or web but that is not the requirement.

Each nozzle row forms a new consecutive layer of evenly distributed material or chemical on top of the previous layer starting from the original substrate that can be a paper web or a forming wire. This allows for a complete engineering of all paper products to maximize their most desired properties. This can be done to a precision that is far above the capabilities of current technology.

The spraying environment inside the box, as described in this invention, prevents the viscous materials from solidifying inside this apparatus. The box can also be sealed both mechanically and/or dynamically to prevent the ambient air from entering the box and the potential aerosols from exiting the box. The optimal spray environment is generated by maintaining about 100% humidity inside the box and preventing or balancing the external air from entering the box. This semi condensing environment is generated and controlled by the humidity and water content in the propellant gas, and the amount of exhaust from the box into the gas purification system. A layered approach with temperature controlled liquid inside the box walls is needed for some applications, where the inner wall of the box might be chrome or Teflon coated, or have a specific liquid repelling inner surface built e.g. the way silica particles are positioned on a surface and affixed in exacting sub-millimeter positions. Additionally steam and gas/air blades and mechanical seals can be used in securing the open areas to prevent air from entering and aerosols from escaping the box. Chemical aerosols are harmful to people and equipment, especially electronics.

The typical operating conditions for the current paper manufacturing unit processes in Table 1 are compared to the same after spray retrofitting:

TABLE 1

Unit Operating Consistencies in Percent with Current or this Spray Technology

| Unit Process | Current Technology | Spray Technology Range | Spray Technology Typical |
|---|---|---|---|
| Paper Web Forming | 0.4–1.5% | 0.4–15% | 3–8% |
| Ply-Bond (starch spray between web layers) | 1.5–4% | 1.5–18% | 5–18% |
| Sizing on Wire Section (or before) | 0.4–1.5% | 0.4–18% | 5–18% |
| Filling on Wire Section (or before) | 0.4–1.5% | 0.4–50% | 10–50% |
| Sizing on Dryer Section | 8–10% | 8–18% | 12–18% |
| Pigmenting/Pre-coating on Dryer Section | 8–10% | 8–45% | 12–45% |
| Coating on Dryer Section | 45–65% | 45–65% | 45–65% |
| Coating on Off Machine Coater | 45–65% | 45–65% | 45–65% |
| Specialties, including microcapsules & barriers | 10–65% | 10–65% | 10–65% |
| Sheet Re-Moisturizing | Water | Water | Water |

The lower the solids at application the higher the amount of material and water is re-circulating in the system resulting to material losses, or when application is done on formed paper web the more-water has to be removed by mechanical means or evaporated. Regardless of the case the current manufacturing methods are low in productivity, waste raw materials, consume unnecessarily large amount of energy and are environmentally unfriendly.

The system is controlled with generally commercially available technology. However, as some applications operate at elevated temperature areas the associated electronics and motors are protected through a separate compartment that can be insulated and cooled by blowing air or by installing cooling pipes. Each nozzle has a double control/information collection feature that allows the operator to know the status of the nozzle without actually seeing it. This feature is achieved by the excessive information process steps: The sprayed material is taken from the pressure controlled main distribution line into nozzle line through a specific orifice; Line pressure is measured again after the orifice; Step-motors with position indicators control the liquid valves leading to the nozzles. The humidity or liquid into the motive gas line of the nozzle are controlled separately as needed.

According to this invention the paper surface doctoring without removing any material is a very important step especially with coating, and is done by specially designed doctors or rollers as shown in FIGS. 4, 5, 6 and 7. The main feature of these doctors is their ability to secure touching of the paper web, applying minimum loading to the web, and allowing the applied material to pass by without removing any, only allowing the material to shift around slightly. This non-metering effect is impossible to achieve with any the current doctoring devices with solid backing devices that form rigid gaps. In this invention the hydrodynamic balance between the applied force from the doctoring device and the existing viscous liquid layer are carefully tuned to maximize the evenness in this layer without destroying it. In essence all the above doctoring devices are hydroplaning, supported by this balance, and push any excess liquid into any valleys while escaping the contact with the underlying solid paper web.

The drying of the paper can be done with the current technology and practices in the industry. Sometimes the spray unit can be followed by special Teflon or chrome coated cylinders enforced with infrared dryers before them, followed by high speed air dryers, or any of the multitudes of drying systems used by the paper industry.

DETAILED DESCRIPTION OF THE INVENTION

Figure 1:
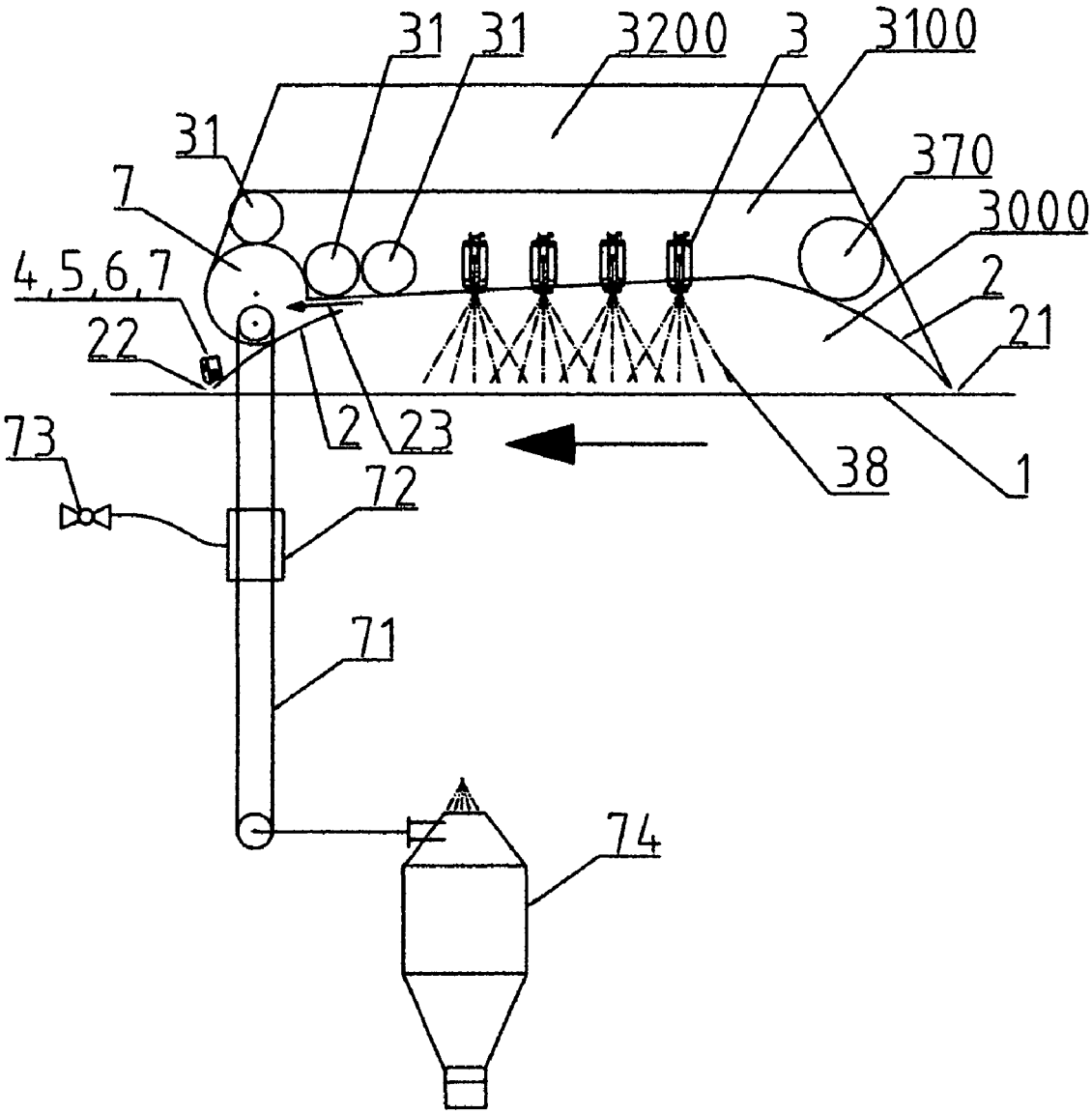
FIG. 1 is a spray box unit containing four spray nozzle rows

FIG. 1 comprises of a Spray Box Unit consisting of four distinct spray sections that include the spray area 3000, spraying equipment with nozzle bodies 3100, space for control systems 3200, and an attachment 7 for collecting the excess gases 23. The outer housing for sections 3100 and 3200 is case dependent and they are not shown in further Figures. The spray area 3000 is limited by the substrate 1 to be sprayed generally a paper web or fine mesh wire, a generally adjustable gap 21 on incoming side, adjustable gap 22 that is modified by a separate closure mechanism 4, 5, 6, or 7, the inner wall 2 that is generally specially coated with materials including i.e. Teflon but can include a double wall cooled construction, and an opening allowing the excess gases 23 to be removed from the box parallel and in close proximity of the wall containing the tips of the spray nozzles 3. The spraying equipment section 3100 contains the nozzles 3, spray material distribution piping 31, motive gas distribution pipe 370 and connecting tubing and control valves generally as shown in details in FIG. 8. The separated section 3200 that is cooled with coolants including air houses all electronic control and communication means including e.g. the step motors for control valves 35 in FIG. 8. The excess gases combined in a manifold type piping 7 and led through the transport piping 71, aided by pressurized gas driven valve 73 controlled ejector 72 to a separate gas washing 74 system shown in FIG. 11.

Figure 2:
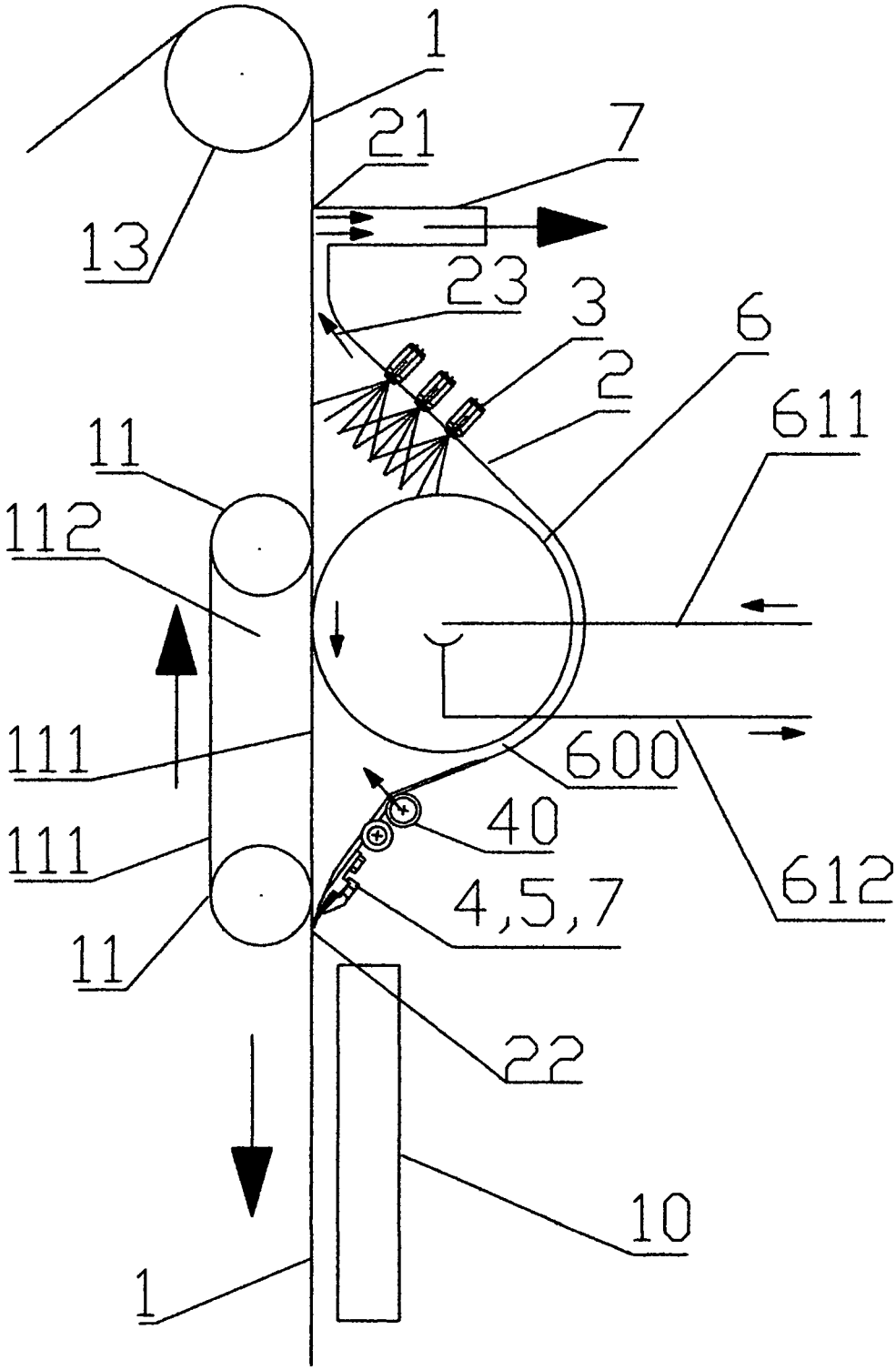
FIG. 2 is a vertical installation alternative for a spray unit

FIG. 2 comprises of a system that applies spray onto vertically running paper web 1, supported by roller 13 creating high quality paper surface required in most demanding paper and board coating applications by evening the coated surface in two consequent doctoring steps 4, 5, and 7. The first step is achieved with a hydroplaning, rotating sweat-roll 6 that is internally cooled 611, 612 or heated to desired temperature, generally between 10 and 80 degrees C. The second step is done with various specially designed doctoring devices as shown in FIGS. 4 to 7 separately. The gap 600 doses the hydroplaning roll inside the spray area. The backing wire 111 supported by rollers 11, and sometimes aided by vacuum 112 will allow for the most flexible doctoring pressure utilization of the hydroplaning roll 6. An Infrared dryer 10 is shown here as an example of a typical first drying apparatus after a coating station to solidify the coating layer before further drying with heated cylinders.

Figure 3:
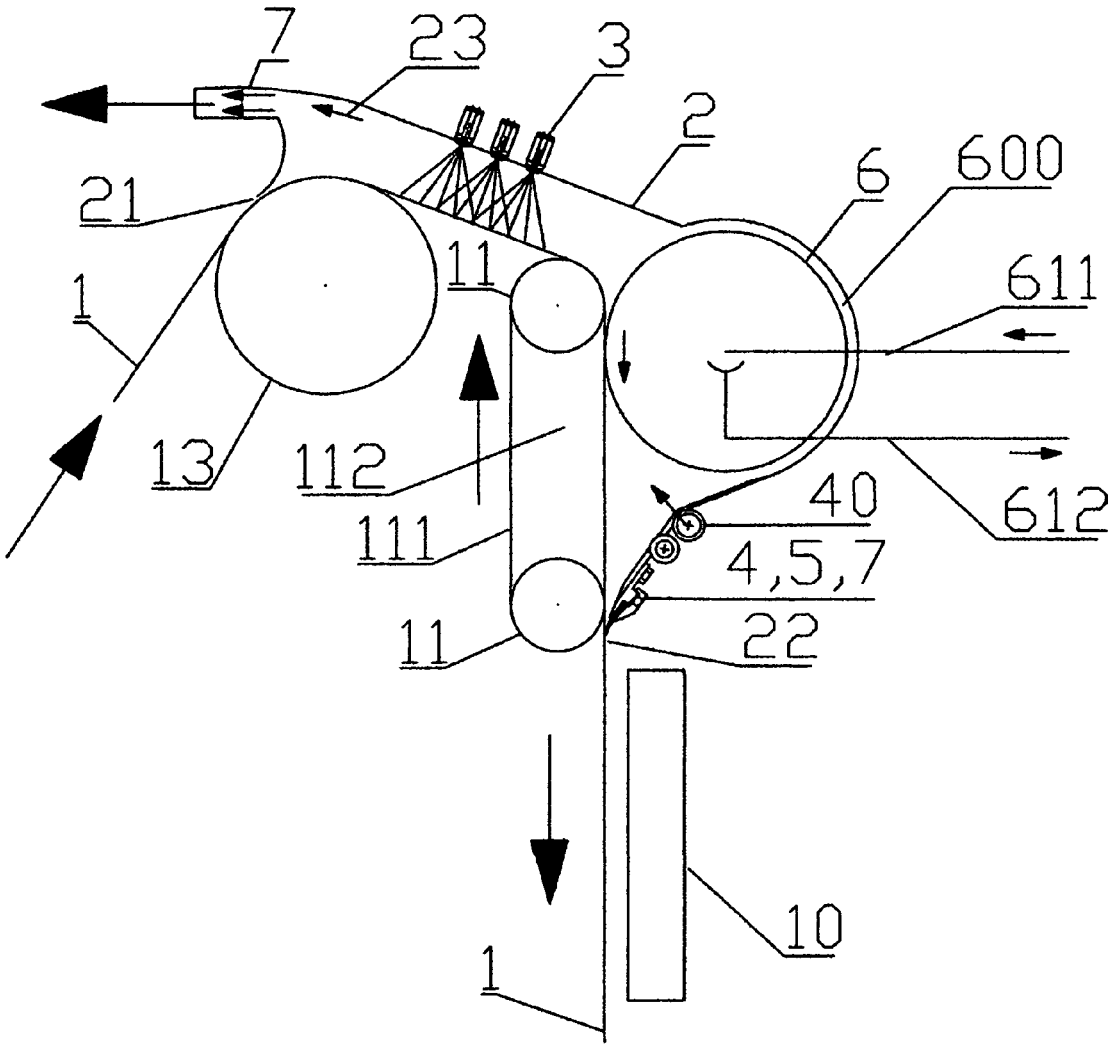
FIG. 3 is another vertical installation alternative for a spray unit

FIG. 3 comprises a generally similar system as in FIG. 2 but now the spraying itself is performed more downwards as may be needed in some cases.

Figure 4:
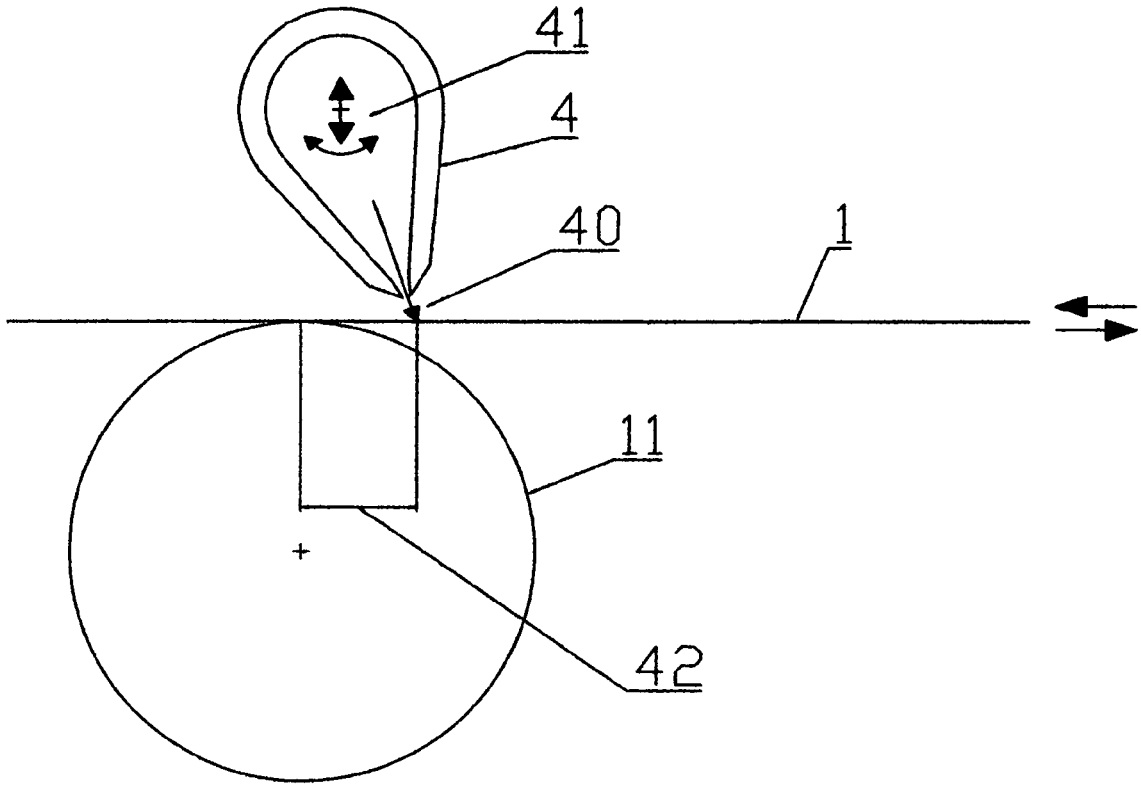
FIG. 4 is a gas jet based doctoring device

FIG. 4 comprises of a non touch cold/hot, or moist gas 40 driven controllable 41 doctoring device 4 and roller 11 that are not used to remove material from the surface of the web 1 and doctoring device 4 can either precede or trail roller 11. The doctoring effect only shifts material in a small scale laterally on the surface. The soft touch is further enforced by a gap 42 that with backing roller 11 prevents the hard solid nip doctoring effect, created by hard backing devices used in the air knife coaters in the paper industry. However, if the non-metering doctoring device 4 is installed on paper machine wire section roller 11 can be omitted as the system is used in this specific area mainly to prevent aerosols from escaping the spray box.

Figure 5:
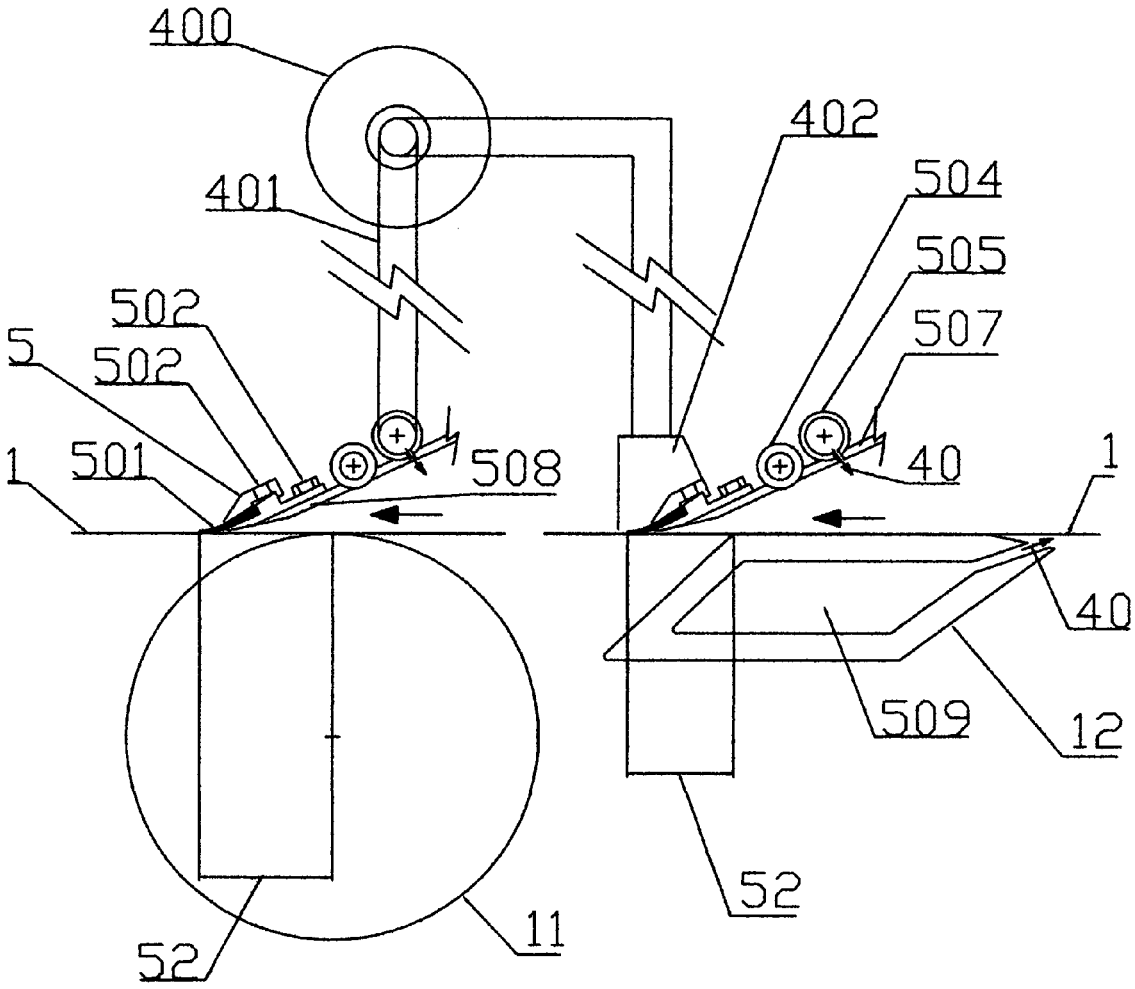
FIG. 5 is a non-metering doctor blade with two examples shown

FIG. 5 comprises of two examples of solid blade non-metering devices 5 and roller 11, and 5 and table 12 that are different from conventional industry doctors as they can not remove material from the web 1 surface but can shift it laterally in a small scale. This inability to remove material is secured as there is no solid backing device as would be needed. The material shifting power is controlled by the gap of 52 that together with web tension impacts the material shifting capability of this doctoring device. The non-metering device consists of a replaceable blade 501 that can be either rigid or soft and easily bending, support mechanism 502, 507 and 508 and load changing system 504, steam, air or wet gas 40 injection distributor 505 used when needed. When wet gas like steam is injected it condenses immediately as a thin solid layer on the top of the coating improving further the quality of paper surfacing. However, if the sprayed materials are temperature sensitive, like paper coatings, this distributor 505 can also be fed with stable water mist generated by ultrasonic mist generator 400 and then ducted 401 to this distributor. It may sometimes also be desirable to replace the typical doctor shower nozzles, not shown, with fine water mist provided through a separate mist distributor 402 to secure wetting of the tip of the non-metering doctor blade 501.

Figure 6:
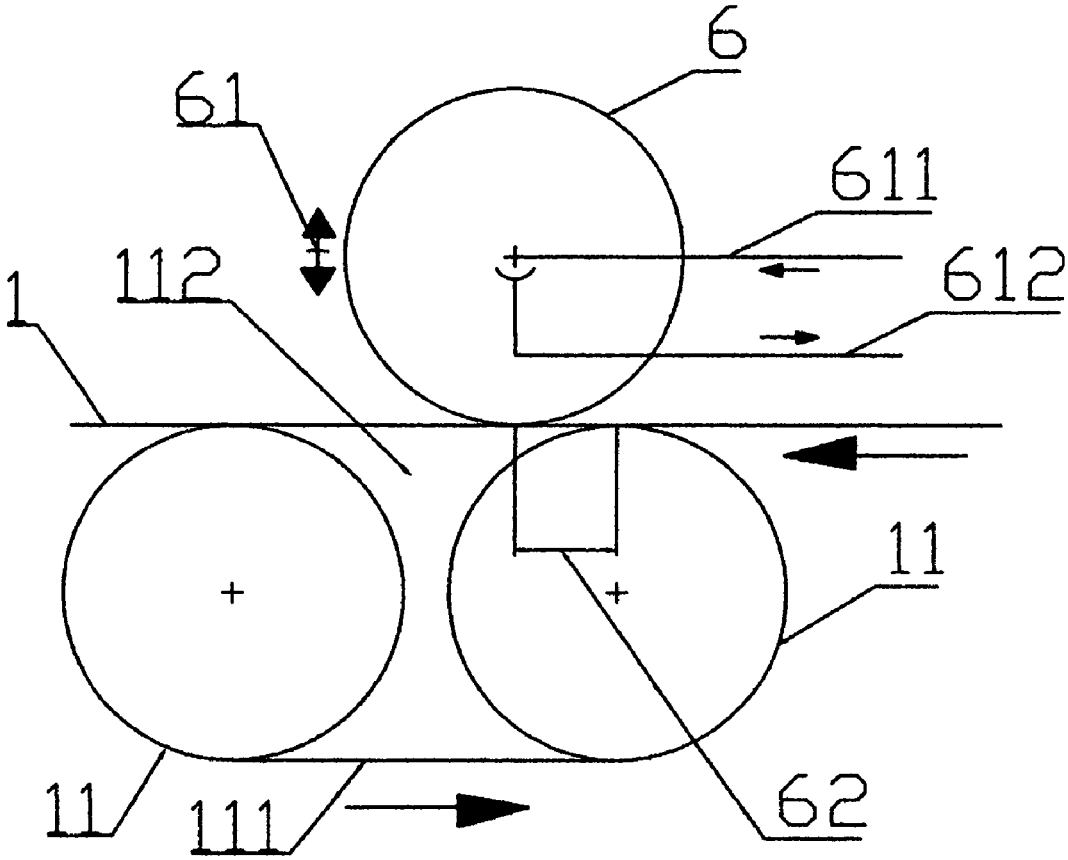
FIG. 6 is a hydroplaning roll with web support from the back side
Figure 7:
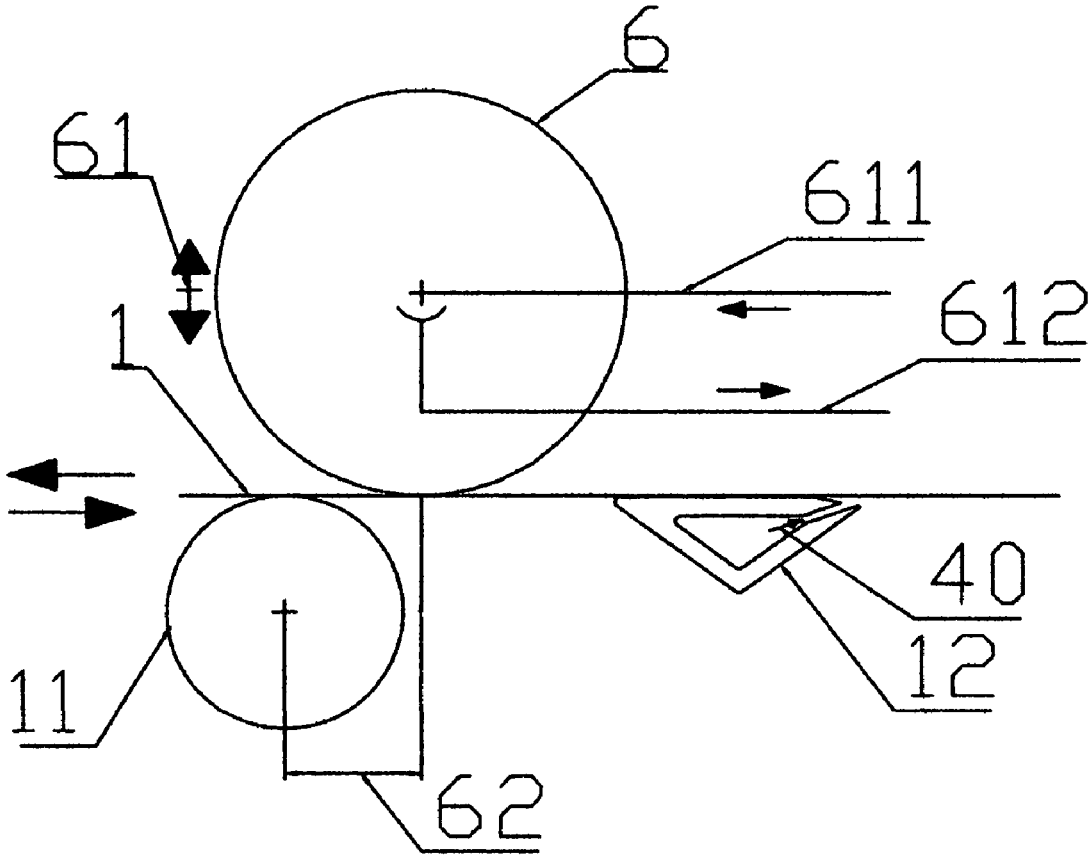
FIG. 7 is a another hydroplaning roll alternative without web support from back side

FIGS. 6 and 7 show the rotating temperature controlled hydroplaning sweat/hot rollers 6 and their backing devices 11, 111, 12 located behind the moving paper web 1. The hydroplaning of a roller starts when its speed is lowered about 10% below the speed of the paper web. At this critical balance point all film splitting and aerosols will disappear. However, when installed according to FIGS. 2 and 3 the rollers can also operate as normal rollers pressing the sprayed liquid into the web as needed, and the following non-metering devices 4, 5, or 7 will be sufficient to even the additional liquid ribbon structures forming after these rollers. The desired surface temperature of the hydroplaning roller 6 is controlled as desired by pumping temperature controlled water or oil through, as practiced in different applications in the industry. The cold temperature causes the roll to sweat, or initiate condensation, preventing materials like coatings from sticking on its surface, and when heated materials like starches become fluid and will not solidify like they do on cold surfaces. Sweat roll 6 can be adjusted both horizontally 62 and vertically 61 allowing the maximum control for its loading. In case a backing wire 111 is used the web 1 itself is released from most of the stresses caused by the hydroplaning effect, and in some cases a slight vacuum under the wire 111 will secure that the sheet is not negatively impacted. In case a solid backing device or backing table 12 is utilized a gas flow 40 will prevent any friction load to web 1 caused by the said backing device.

Figure 8:
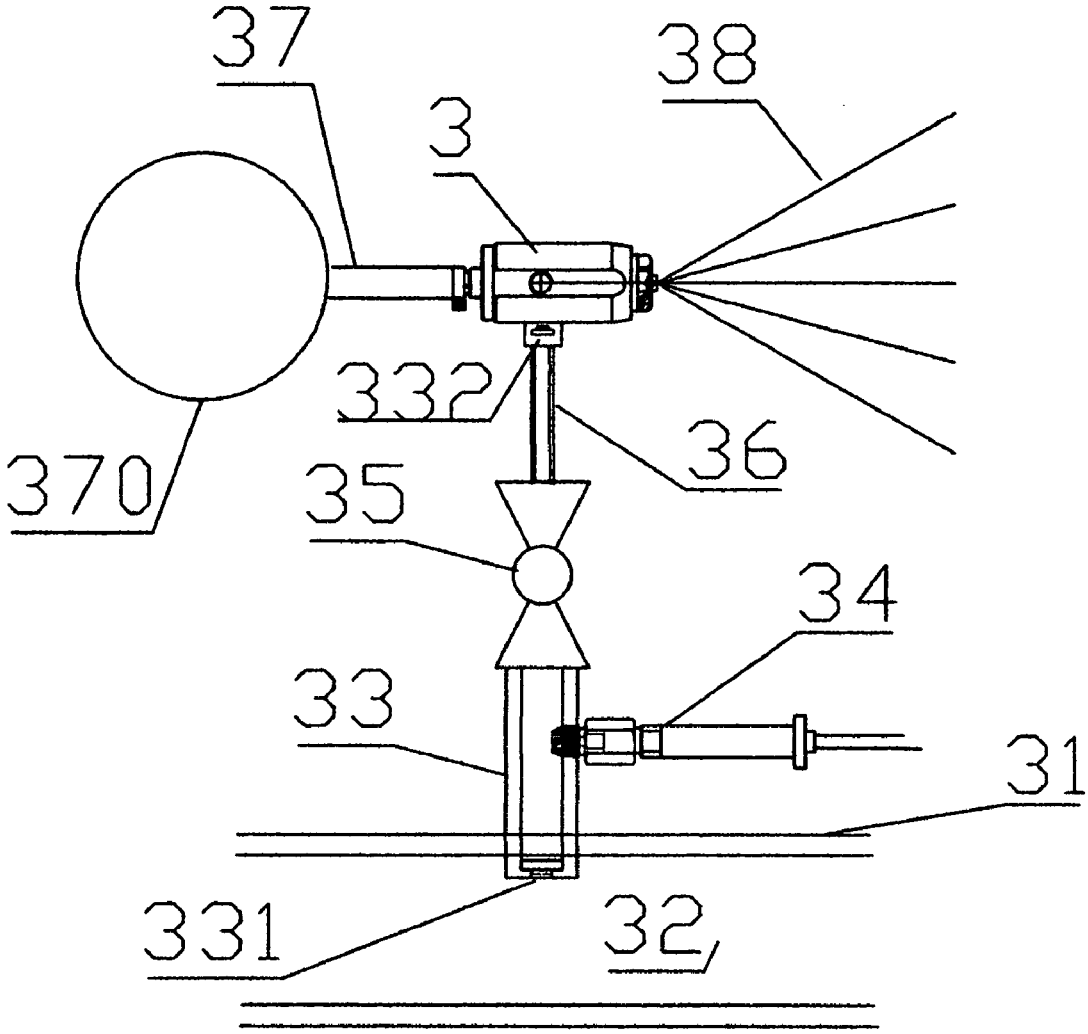
FIG. 8 is a schematic of a nozzle control system

FIG. 8 comprise control logic of an individual nozzle 3 when combined in this invention with a position sensing step motor, driving control valve 35, and when connected to a computer the system can do internal nozzle flow diagnostics without operator input. In this illustration the tube 37 provides the motive gas, and 38 illustrates the spray pattern out of nozzle. The spray liquid 32 is brought in by main distribution pipe 31 and liquid is taken to the nozzle line through a restriction or orifice 331 and further via tubing 33 to the control valve. The pressure sensor 34 determines together with pressure sensor in the main distribution pipe the flow into the nozzle 3. As the valve characteristics, step motor position and pressure sensor 34 already determine the flow a rising discrepancy initiates a self cleaning process and warns the operator of a potential impending problem. Tubing 36 takes the fluid into nozzle, and this line can include another restrictor or orifice 332 depending on the nozzle type.

Figure 9:
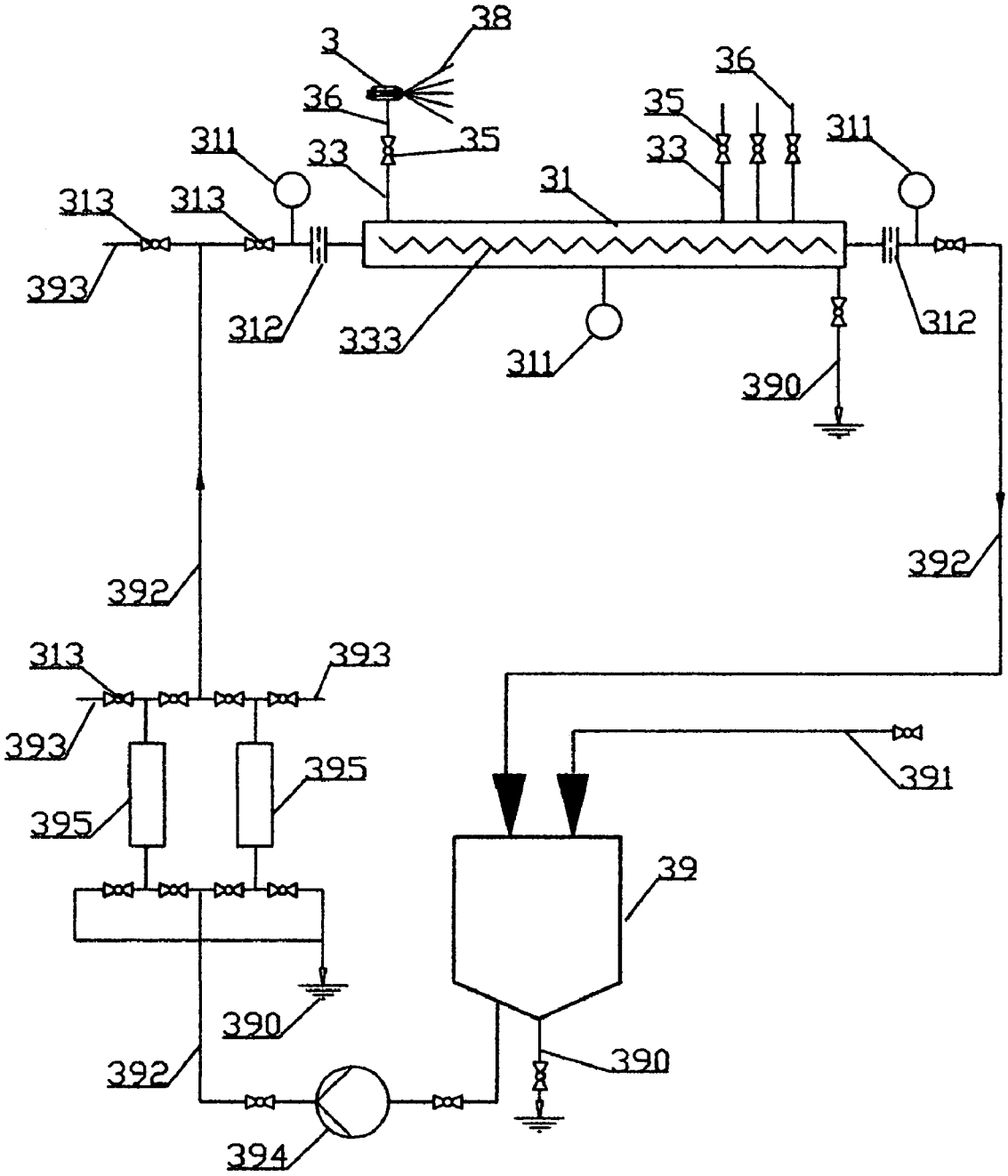
FIG. 9 is a schematic showing a spray liquid supply system

FIG. 9 comprises of a spray storage and supply arrangements into the nozzles 3 in FIG. 8. The system starts from storage tank 39 that is supplied through a feed line 391. From the tank the liquid is pumped by pump 394 through line 392 to two parallel filters 395 and continuation of line 292 to the nozzle distribution header 31 and excess returned back to the storage tank through continuation of line 392. A constant pressure is maintained in the nozzle distribution header 31 and the pressure and flow are measured and controlled with related valves 313 and pressure 311 and flow 312 sensors. The system is cleaned with wash water 393 and flushed clean through the lines 390. In case that paper making fibers are sprayed the distribution header can be equipped with a mixing device 333, in its simplest form a helical screw, but can include other mechanical mixers and ultrasound to keep the fiber suspension fluidized and the intake restrictors in tubing 33 clear, FIG. 8. In this latter case the filters 395 are replaced with appropriate screens.

Figure 10:
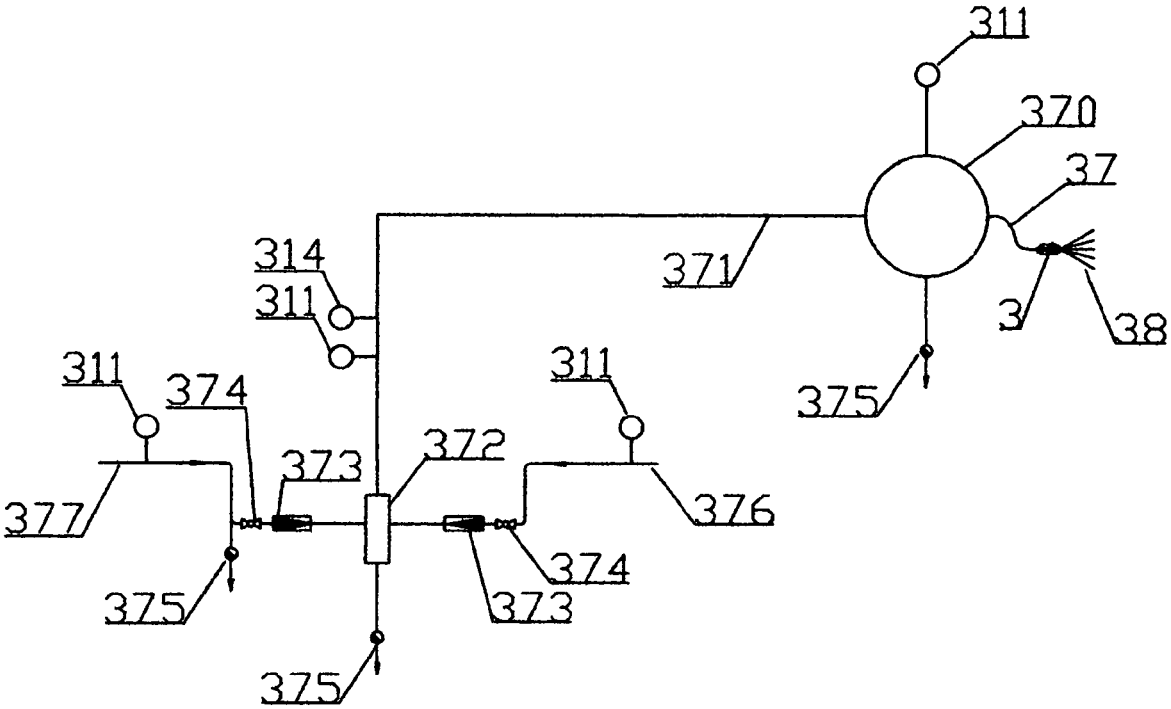
FIG. 10 is a schematic for motive gas supply and mixing gases like e.g. air and steam

FIG. 10 comprises the motive gas header 370 and mixing 372 of two gases 377 and 376 including the potential condensate removal 375 arrangements. Both incoming gas lines are monitored for incoming pressure 311, condensate is removed when needed and flow is controlled with valve with a check valve preventing the backflow to these separate systems. After mixing the resulting gas is monitored for temperature and pressure in line 371 leading into the distribution header that is providing the motive gas for individual nozzles 3 through lines 37.

Figure 11:
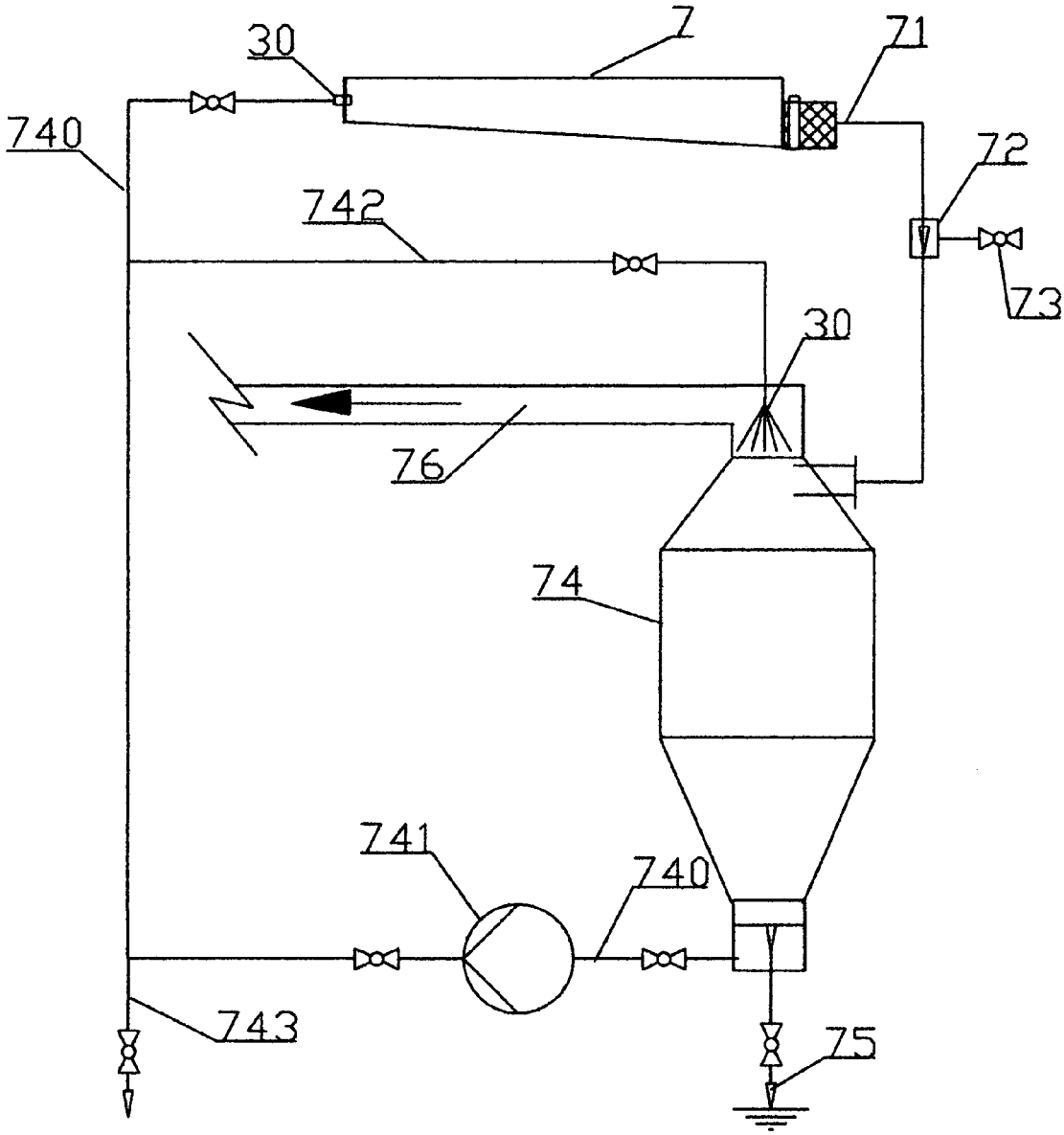
FIG. 11 is an excess gas washer

FIG. 11 comprises of a excess gas washer 74 and cleaning system. The gas cleaning starts from the spray box unit extraction manifold 7 and continues through the air piping 71 and gas ejector pump 72 to excess gas cleaning cyclone where the gases are cleaned by washing showers 30 and then released to the atmosphere through duct 76. The washing water is collected at the bottom of the cyclone and recycled 740 by pumping 741 to initial washing in the manifold collection tube 30, and washing liquid in the cyclone 742. Excess 75 will be released from the process to effluent treatment only during process start-ups and shut downs.

Figure 12:
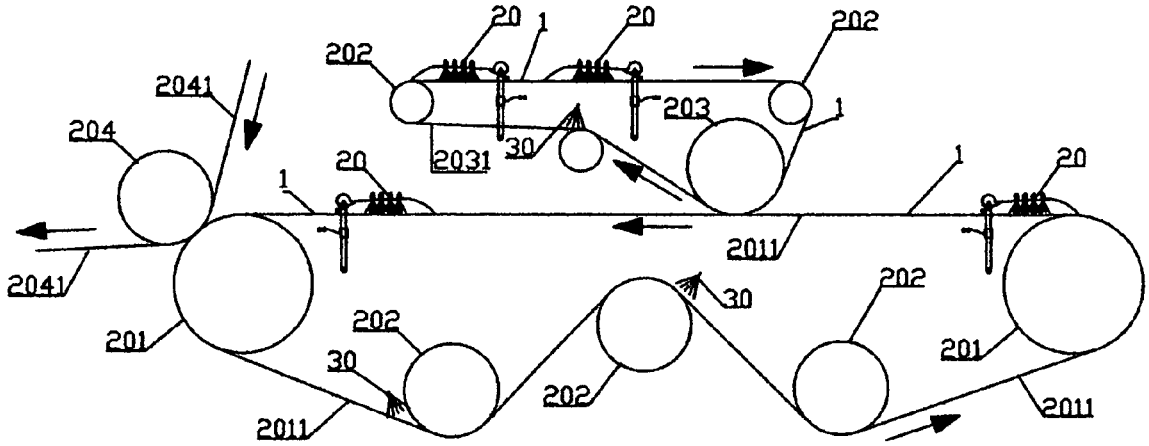
FIG. 12 is a schematic showing paper web forming examples by spraying

FIG. 12 comprises of exemplary spray units 20 in paper manufacturing using rotating fine mesh wires 2011, 2031 as substrate to spray fibers to form the initial web 1. After this further fiber spraying is done on already formed web covering the wire. Various rollers 201, 202, and 203 accommodate the movement of the rotating wire while the cleaning showers 30 keep the wire mesh clean for the new fiber mat. The finished web is then transferred to the dryer section with a vacuum aided roller 204 and felt 2041 pressing against the roller 201 and picking up the web.

Figure 13:
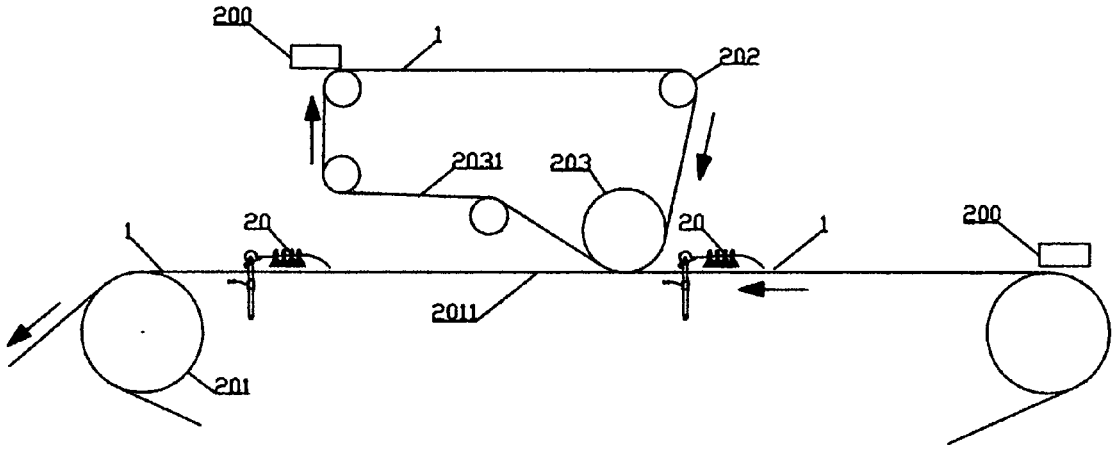
FIG. 13 is a schematic showing examples of ply-bonding followed by web surfacing

FIG. 13 comprises of exemplary spray units 20 surfacing the already existing paper web in the machine wire 2031, 2011 section. The machines can have one or several wire units depending on how they were built at the time. This featured machine is making a two ply paper and the top and the bottom plies are manufactured the conventional way using standard Head Boxes 200 to manufacture the top and bottom web layers. The manufactured two web layers are then glued together with a spray unit 20 just before the webs get together between the roller 203 and wire 2011. After that another spray unit 20 adds i.e. a white mineral layer on top of the combined sheet preparing the sheet for further treatments like coating.

Figure 14:
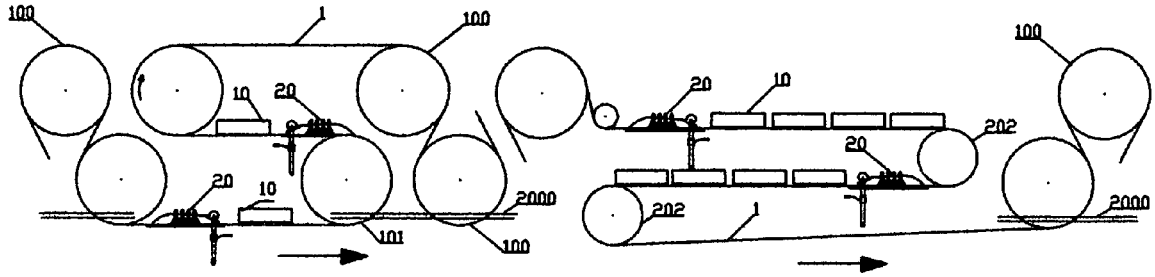
FIG. 14 is a schematic showing web surfacing examples on dryer section

FIG. 14 comprises of exemplary spray units 20 first (from left to right) sizing the paper web in a two sided sizing and then finishing it by two sided coating. The infrared dryer units 10 are followed each spray unit to solidify the sprayed material onto the surface. Roller 101 turns the web for sizing/treating facing the other side before drying on cylinders 100. The rollers 202 turn the sheet for coating facing the other side before final drying on the drying cylinders 100.

Figure 15:
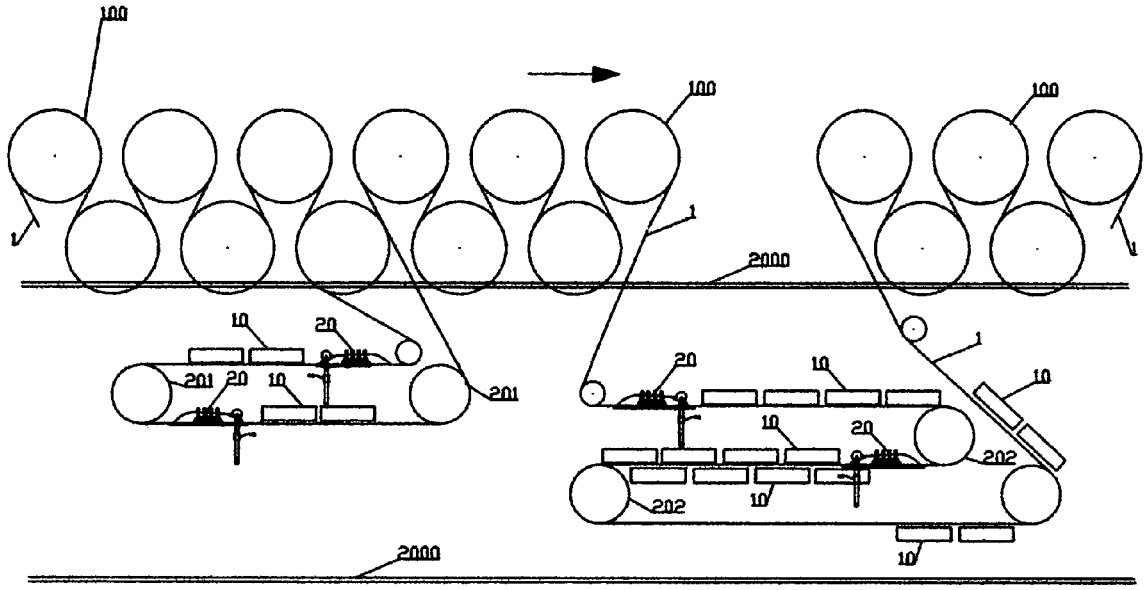
FIG. 15 is a schematic showing web surfacing examples below the dryer section

FIG. 15 comprises of exemplary spray units 20 first used in the machine basement if there is no possibilities to install the units on the dryer section itself. The floors of the building are marked as 2000. The system can be built a myriad of ways on existing and new paper machines based on concepts shown in FIGS. 1, 2 and 3 and each case has to be assessed separately.

The invention claimed is:

1. An apparatus for paper making comprising a spray box, a paper web substrate moveable at speeds up to substantially 1800 meters per minute below said spray box, multiple nozzles mounted inside said spray box for cross-directional profiling achieved by means of each nozzle spraying a controlled amount or suspended solids including fibers, minerals and chemicals onto said substrate, said spray box including a substrate entry point and a substrate exit point, said entry and exit points comprising respectively adjustable entry and exit gaps disposed above said substrate, aerosols emitting from said nozzles, means to remove said aerosols from said spray box, a device for smoothening the surface characteristics of said suspended solids having a distal end, said distal end being adjacent a point on one side of said substrate, a roller disposed on the other side of said substrate and in abutment therewith, and said adjacent point being spaced laterally along said substrate from the location of said abutment.

2. The apparatus according to claim 1 wherein said exit gap is adjustable by means of a gas driven doctoring device.

3. The apparatus according to claim 2 wherein a roller is disposed below said substrate opposite said gas drive doctoring device.

4. The apparatus according to claim 1 wherein said exit gap is adjustable by means of a blade.

5. The apparatus according to claim 4 wherein a roller is disposed below said substrate opposite said blade.

6. The apparatus according to claim 1 wherein said exit gap is adjustable by means of a hydroplaning roller.

7. The apparatus according to claim 6 wherein a roller is disposed below said substrate opposite said hydroplaning roller.

8. The apparatus according to claim 1 wherein said aerosols are removed from said spray box by means of a piping and valve assembly.

9. The apparatus according to claim 8 wherein said aerosols are forced through said piping by means of a pressure valve to a gas washing system.

10. The apparatus according to claim 9 wherein said gas washing system comprises a cyclone based air washer.

11. An apparatus for paper making comprising a spray box, a paper web substrate moveable below said spray box, multiple nozzles mounted inside said spray box for spraying suspended solids onto said substrate, said spray box including a substrate entry point and a substrate exit point, said entry and exit points comprising respectively adjustable entry and exit gaps disposed above said substrate, aerosols emitting from said nozzles, means to remove said aerosols from said spray box, a device for smoothening the surface characteristics of said suspended solids having a distal end, said distal end being adjacent a point on one side of said substrate, a roller disposed on the other side of said substrate and in abutment therewith, and said adjacent point being spaced laterally along said substrate from the location of said abutment.

* * * * *